US005466148A

United States Patent [19]

Witteveen

[11] Patent Number: 5,466,148

[45] Date of Patent: Nov. 14, 1995

[54] LOW NOX COMBUSTOR

[76] Inventor: Gustaaf J. Witteveen, Stationsstraat 41, 6584 AS Molenhoek, Netherlands

[21] Appl. No.: 154,547

[22] Filed: Nov. 19, 1993

[30] Foreign Application Priority Data

Nov. 20, 1992 [NL] Netherlands ..... 9202022
Feb. 3, 1993 [NL] Netherlands ..... 9300213

[51] Int. Cl.[6] ..... F23L 7/00

[52] U.S. Cl. ..... 431/116; 431/174

[58] Field of Search ..... 431/114, 115, 431/116

[56] References Cited

U.S. PATENT DOCUMENTS

| | | | |
|---|---|---|---|
| 2,515,845 | 5/1947 | Vandenbussche . | |
| 3,754,393 | 8/1973 | Handa | 431/116 |
| 3,869,244 | 3/1975 | Von Linde et al. | 431/116 |
| 4,150,539 | 4/1979 | Rubins . | |
| 5,350,293 | 9/1994 | Khinkis et al. | 431/116 |

FOREIGN PATENT DOCUMENTS

| | | |
|---|---|---|
| 0003000 | 7/1979 | European Pat. Off. . |
| 195360 | 9/1986 | European Pat. Off. . |
| 038886 | 9/1990 | European Pat. Off. . |
| 1551792 | 4/1970 | Germany . |
| 2810193 | 9/1979 | Germany . |
| 9100490 | 10/1992 | Netherlands . |
| WOA92/06328 | 4/1992 | WIPO . |

*Primary Examiner*—Carroll B. Dority
*Attorney, Agent, or Firm*—Larson & Taylor

[57] ABSTRACT

The invention relates to a combustor, such as a burner or a cylinder of an engine with internal combustion, where combustion fluid passing through a slit (2,3; 6,7; 8,9; 11,12; 21,23; 31; 36,37; 39; 45; 48,49; 54; 61; 70,71,73,78; 96'; 109,110; 81; 124; 128), which may be straight as well as ring-shaped, is ignited in a space which allows for the development of turbulence. Said development of turbulence is caused by providing that bD/v>1000, and preferably >2000, where b represents the width of the slit, D the distance between two consecutive slits or the width of the space and v the kinematic viscosity of the supplied combustion air. In accordance with further embodiments of the invention, guiding members are placed to sustain said turbulences and/or to feed combustion gases back to the ejected peel-shaped jet. Thus a very low NOx value is obtained and it is likewise possible to construct a stable burner with a very wide adjustment range.

7 Claims, 12 Drawing Sheets

FIG.1
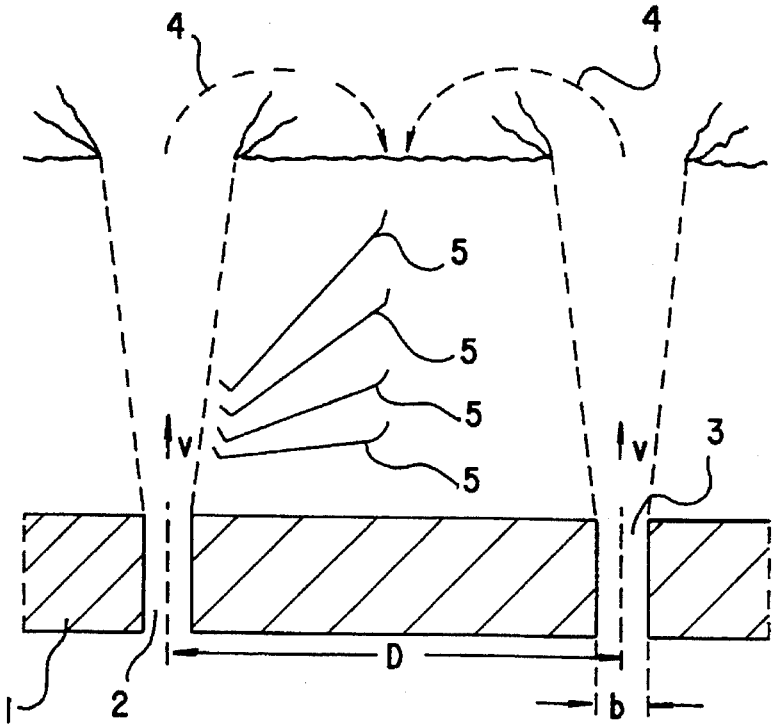
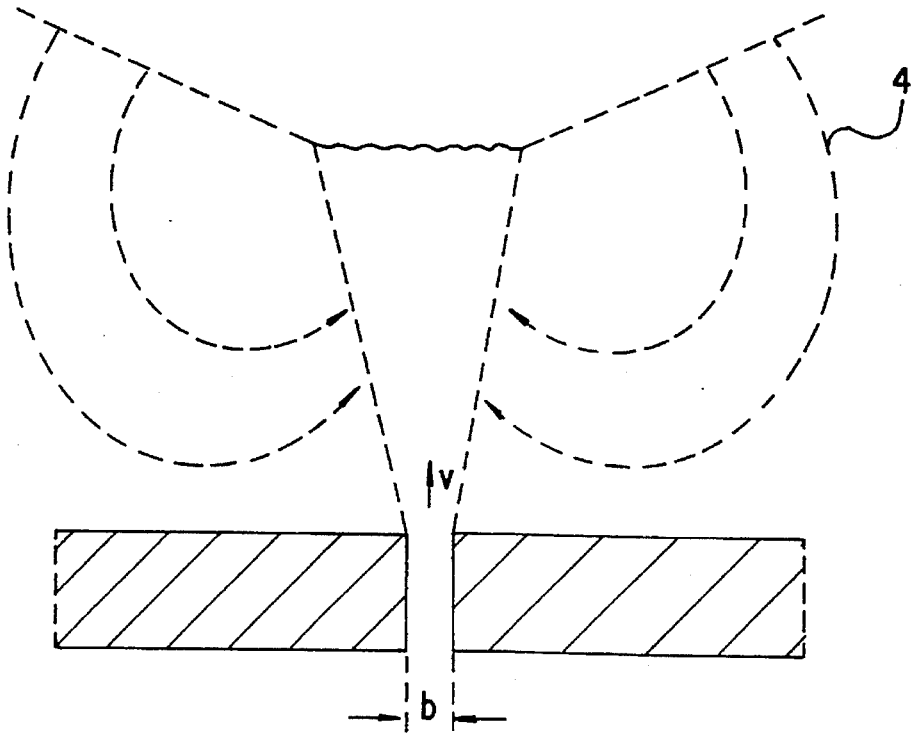
FIG.2

FIG.16
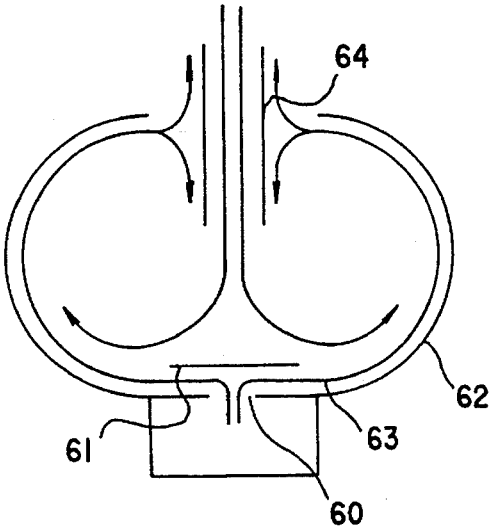
FIG.18
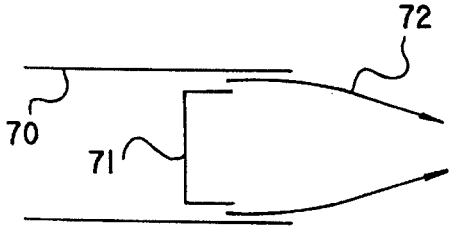
FIG.17
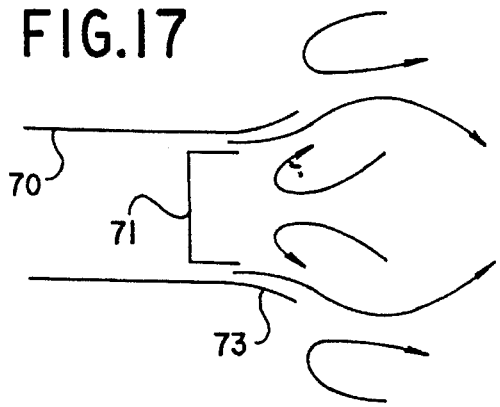
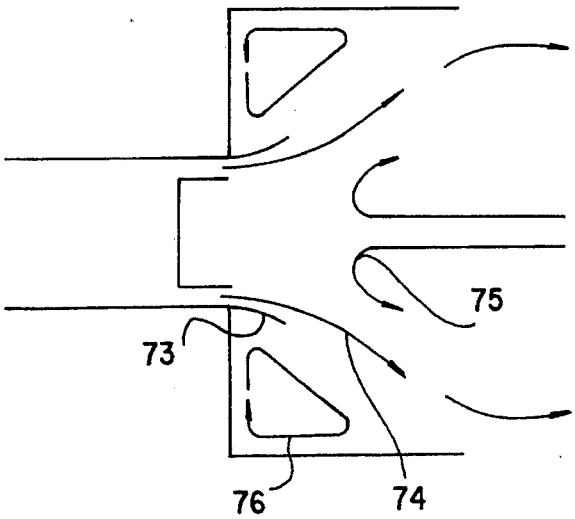
FIG.19
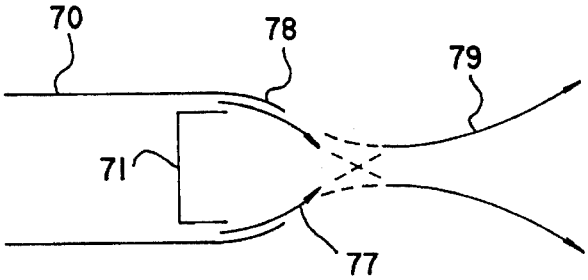
FIG.20

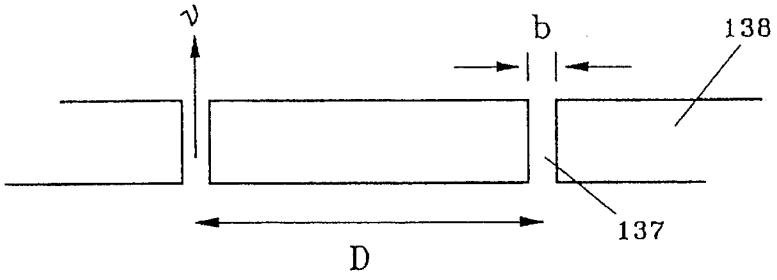
FIG. 28
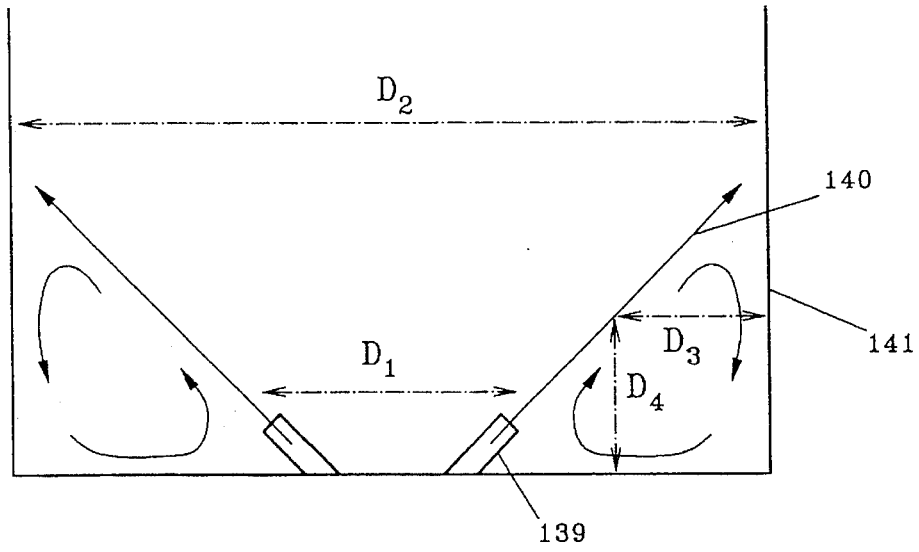
FIG. 29
FIG. 30
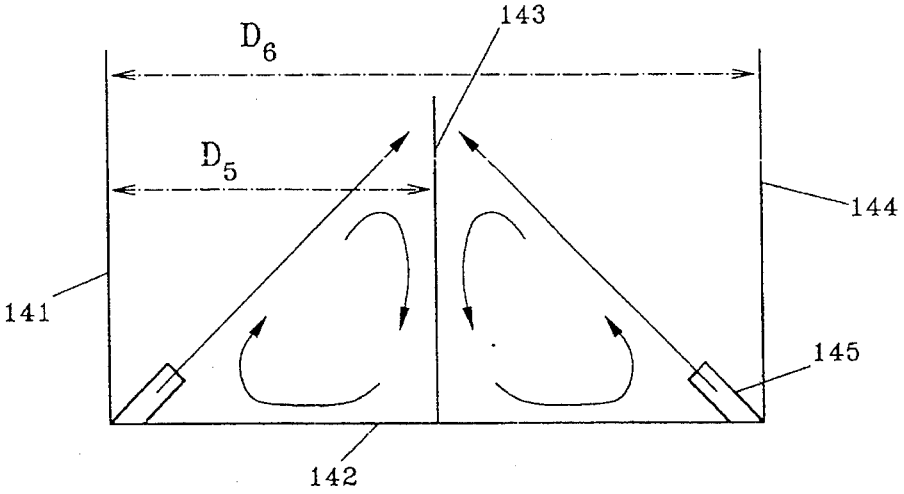

A : n1

B : n2

C : n1; b1; D1

D : n2; b1; D1

E : n1; b1; D2

F : n2; b1; D2

G : n1; b2; D1

H : n2; b2; D1 n1 = 1.3
n2 = 1.17
b1 = 0.4 mm
b2 = 0.8 mm
D1 = 20 mm
D2 = 10 mm

LOW NOX COMBUSTOR burning fuel, which entails high temperatures, in general nitrogen oxides will form. In order to prevent said formation, it can be provided that the temperature of combustion is relatively low. This is for example to be achieved by means of an excess of air, in which case the heat obtained by combustion is to be divided over a relatively great amount of combustion gas, or by applying recirculation of already burned and partly cooled gas that is mixed with the combustion air, causing the combustion temperature likewise to be lowered.

Another method of keeping NOx formation reduced, is constituted in that a very intensive mixture of combustion air and material to be burnt, in general to be burnt gas, is effected, which may not lower the combustion temperature, but, on the other hand, will cause the duration of said high temperature to be so short that likewise a low NOx content is obtained. This reduction of the NOx content by means of thoroughly mixing gaseous fuel and combustion air has roughly resulted in a reduction of 100 to 20 ppm.

The invention aims at obtaining an even considerably further reduction of the NOx content in the combustion gases, by employing simple means. In this the invention is based on the understanding that, by conducting a layer or peel-shaped jet, as is described per se in the not previously published Netherlands patent application 9101896, through a turbulent area consisting of entirely or partly burnt gases, as a result of the slight thickness of the jet and the subsequently rapid penetration of the turbulence into the centre of the jet, while diluting the jet and reducing the combustion temperature, extremely low NOx contents can be achieved, for example to the amount of ¼ of what can be achieved by premixing, described hereinabove.

Based on what has been described hereinabove, the invention provides for a combustor with a fuel feeding device, a flame room, with intake openings for feeding one or more oxygen containing gas flows with an effective diameter, which in one direction is at least five times larger than in the direction perpendicular thereto, so that a layer or peel-shaped gas flow is obtained, characterized in that the intake openings open into a flame room with the dimensions of the free distance D of the intake openings to a fixed part of the flame room, or between the intake openings themselves, and an average velocity v in a considerable part, preferably more than half, of the adjustment range of the combustor, are such that the Reynolds number $vD/\nu$, in which $\nu$ is the kinematical viscosity of the gas flowing from the opening, has a value of over 1000, preferably over 2000. In this case it is not only possible that the layer or peel-shaped gas jet containing oxygen has already been mixed with fuel, but also that, in a way known per se, it is intensively mixed with gaseous or ejected liquid fuel, such as oil or solid combustible elements, provided that the turbulence has already effected the dilution.

In a first embodiment the gas jet is brought into such a space, or the distance between two adjacent gas jets has been selected in such way, that at the flow velocity of the jet, usually obtained when the combustor is in operation, turbulence occurs. When applying the invention, turbulence, or at least a beginning thereof, occurs in the areas adjacent to the gas jet. Moreover, the suction action of a gas jet has an intensifying effect on the suction of combustion gases that consequently reach the jet and ignite. The result is a combustor with an exceptionally low NOx content and a particularly stable flame.

It has been observed that at a value of Re, as has been described hereinabove, of 2000 generally an already noticeable reduction of the NOx content occurs. The considerable velocity gradient on the boundary of the jet creates and/or intensifies turbulences that are then capable of penetrating the jet, diluting it and lowering the temperatures after combustion.

Another way to effect the invention, or to sustain the embodiment described hereinabove, is constituted in that flow-back devices are present within the flame room to lead combustion gases back to the gas jet leaving the openings. The flow-back devices may contain flow guiding or retaining elements. As means of flow-back, guiding members may be fitted that are situated in the gaseous jets and guide said jets, at least partly, back by introducing turbulence by partly blocking the jet and ensuring that turbulent flows of combustion gases reach the jet, in particular at its base range.

It is also possible for one layer or peel-shaped jet to act as a flow-back means for the other.

A further elucidation of the invention provides that back-flow guiding members, optionally together with a wall of the flame room, form a passage for guiding the combustion gases back to the area of the openings. This not only realizes a good back-flow, but possibly closed isolation cells are also connected to the flame room through the passage, as a result of which acoustic vibrations in the circulation room are muffled to a high degree. This embodiment of the invention may provide a decrease of burner-sound by 10 to 15 decibels.

Guiding members can also be present in order to guide combustion gases to such a passage.

In applying the invention it is often important that the divergence of the jet leaving the opening is limited. Accordingly it is preferably provided that the openings are fitted with walls in the flow direction, which are higher, preferably at least twice as high, than the smallest dimension of the diameter of the openings.

A good guiding of a layer or peel-shaped jet is possible by moving it along a surface, while it continues to flow along said surface by means of a curve in the surface or by the Coanda effect.

When, as is often usual with burners, the flame room has an exhaust side, the phenomenon may occur that the jets that are used in the invention, draw an excess of gas, which in its turn also has to be exhausted, so that undesirably high flow velocities may occur. In applying the invention this can be prevented by providing that flow blocking members are placed in the exhaust side.

When in the present description reference is made to an opening, it may also consist of a number of participating openings, provided that the total configuration has a considerably greater length than width.

The invention is likewise applicable to a combustor as has been described in the PCT patent application WO 92/16794. Here, in accordance with a further elaboration of the invention it is preferably provided that a back-guiding member is placed in the track of an outgoing circularly symmetric gas flow. In this it is desirable, but not necessary, that the in the aforementioned PCT application described vortex break down occurs: when the peel-shaped jet having been hurled away, hits a wall and is subsequently made to flow back, a very low NOx stable burning combustor can be obtained without the occurrence of the Vortex break down described in said application.

The invention is not only suitable for burners, but may also be applied to, for example, an engine with internal combustion. Here, the outflow through as slit of a compressed air-fuel mixture, may create a flow pattern when moving back the piston from the opening of said slit, which fully corresponds to the flow pattern obtained in case of a burner according to the invention.

The invention will hereinafter be further explained, reference being made to the drawing, where:

FIGS. 1 and 2 are diagrammatic views showing turbulence caused by a gas flowing through slits in a burner plate;

FIGS. 8–24 and 27 are diagrammatic illustrations of combustion devices in accordance with the invention;

FIGS. 28–30 are diagrammatic illustrations relating to the determination of values "b", "D" and "v" in combustion devices.

Figure 3:
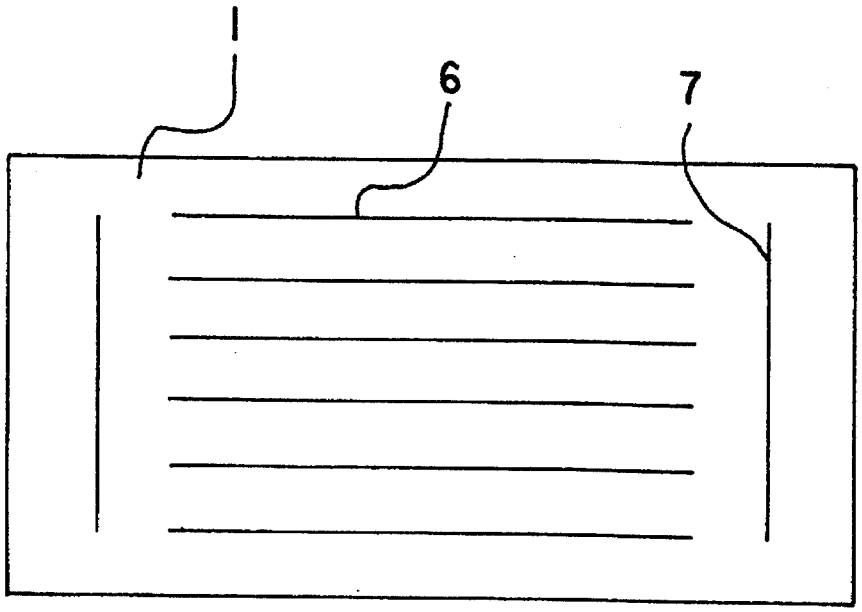
FIGS. 3–7 are diagrammatic illustrations of various arrangements of slits in combustion devices in accordance with the invention.

In FIG. 1, a separating body or burner plate is indicated by 1. Herein slits 2 and 3 are located whose distance between centrelines is D.

When Reynolds number vD/v equals 1000, preferably 2000 or more, a turbulence, which schematically has been indicated by the dotted lines 4, will develop between the flat or plate shaped gas flows coming out of slits 2 and 3, as has been represented in FIGS. 1 and 2.

Furthermore, the flow lines of the flow roughly occurring in the cell between the flows from slits 2 and 3, are indicated by 5. For a single slit the Navier-Stokes equations are exactly solvable. This corresponds to the part 5 of the flow lines. The slightly deflected lines that eventually end up running vertically in the centre of the cell, form extrapolations hereof in order to obtain an in principle symmetrical flow distribution.

The Navier-Stokes equations for incompressible medium with viscosity offer simple harmonic functions as solutions.

Solution of the Navier-Stokes equations leads to the lines 5, indicated in FIG. 1, which on approaching a flow such as 2 or 3 show a fairly sharp deflection. In the flow coming from the slit, mixing occurs, so that a mixture is obtained of unburnt mixture and burnt and possibly cooled mixture.

As a result the flow coming from the slits 2 and 3 is diluted in an already early stage, which leads to a low NOx content.

The flame can be modulated from a flow velocity in the slits 2 and 3 that is at least equal to the flame velocity to flow velocities in said slits that amount to ten/hundredfold the flame velocity, without any danger of the flame blowing off.

When the separating body is made of a good heat conducting material and the thickness of said body is greater than the width of the slit, even a stable flame without any danger of spark jump to the space in front of the separating body 1 can be obtained, at flow velocities v that are nearing the flame velocity.

From such a low flow velocity in the slits, when Reynolds number will generally be considerably smaller than 2000, up to the flow velocity when said number has the value of 2000, the NOx content increases linear with the velocity v. When, however, turbulence is achieved, the NOx content remains constant at the entire further range, able to withstand great surface loads, without any blowing off being feared.

By now selecting dimensions in such manner, being: narrow slits, therefore a high v, and great distances between the slits, therefore great D, it is possible to achieve a situation of turbulence already at a very low heat production per square meter of the separating body. This means that, from this point on, a constant NOx content, which can be extremely low, is obtained. This is why a burner in accordance with the invention, provided with small slits and great distance between them, is capable of realizing an unprecedented low NOx content in the combustion gases, which theoretically can even become as low as 0.

In FIG. 3 a separating body is represented, of a slit burner provided with a number of slits 6, parallel to each other, where at and across the end sides of the slits two slits 7 are placed. Between the slits 6 turbulence cells originate, but also between the end sides of the slits 6 and the slit 7. This configuration is suitable to adjust with a minimum of tension to expansions caused by heating the separating body, for example a metal or ceramic burner plate, which is not evenly heated over the entire surface.

Figure 4:
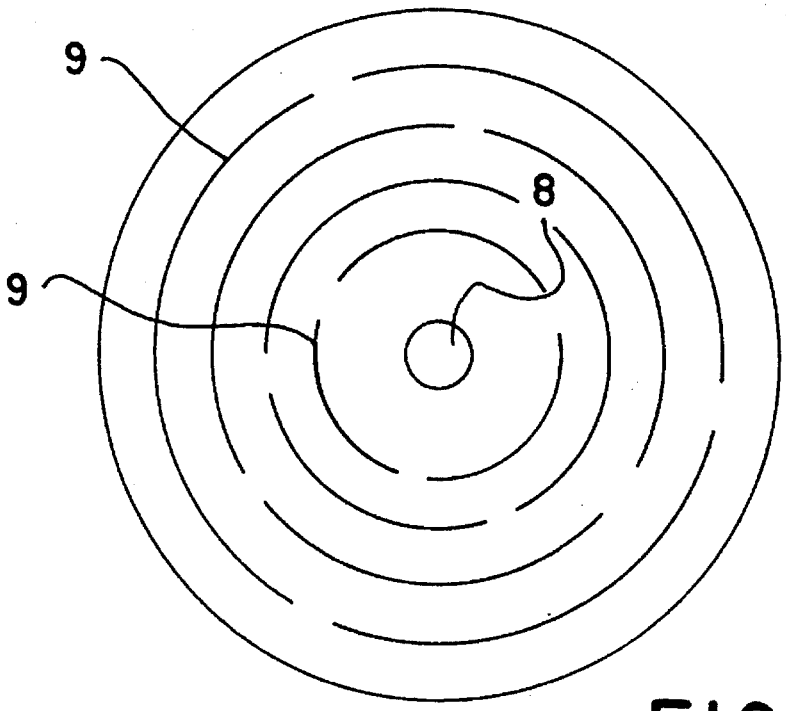

FIG. 4 subsequently shows a burner plate in accordance with the invention, provided with a central opening 8 and around it concentric circular arc-shaped slits 9. Such a separating body produces a circular symmetric flame, which is desired in many applications. Moreover, by making use of a laser beam in order to make the slits, the production of such a plate can be effectively carried out, also when the width of the slit is smaller than the thickness of the plate, which makes stamping the slits virtually impossible.

Figure 5:
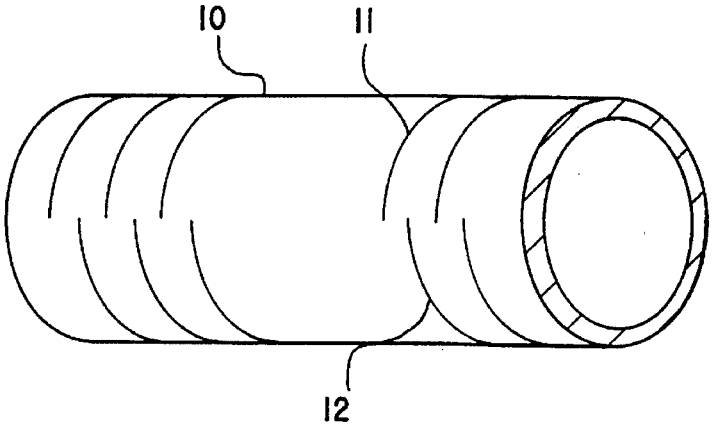

FIG. 5 shows a tube-shaped separating body 10 with passage slits 11 and 12. Each of said slits are circular arcs of approximately 180°. This shape of the separating body can easily be manufactured by sawing-in the tube 10. In doing so, narrower slits can be made than is possible when stamping or punching, also in case of a relatively thick wall of the tube 10. Naturally, use can also be made of a laser beam or of a construction out of ring-shaped elements.

The slit-shaped openings that are used in the invention, may consist of more than one narrow slit, located close together. At a short distance above the separating body the layer-shaped flows are joined together and a single layer-shaped flow with lower flow velocity v than in the individual slits, is created. This offers, among other things, the opportunity to obtain lower velocities v at a certain pressure drop and minimal width of the slits.

Figure 6:
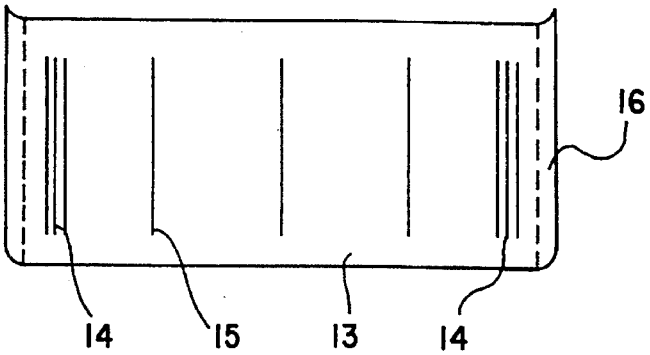

In FIG. 6 an example of a separating body 13 is shown, containing, at the rims, triple slits 14. This causes the flame to be lower above said slits than above the slightly wider slits 15. The plate 13, however, can have at its ends 16 an additional heat sink, for example via ends that are turned downward, whereas a multiple slit, due to its larger wall surface, in itself already can ensure a better heat transfer into the mixture flowing through it.

Slits may also be placed not perpendicular to the burner plate, which offers the possibility, when the inclined slits lean over alternately to one side or the other, to obtain large turbulence cells in case of diverging flows, and smaller ones in case of converging flows.

In addition, it is also possible to feed a gas mixture of different compound to different slits, for instance by feeding into the space under the separating body a relatively rich mixture in the middle, and additional combustion air at the ends, or vice versa. Also a fairly lean mixture can be fed and, in addition, the combustible gas or a mixture of said gas and air. Thus it is possible to combine an ample modulation range with a desired temperature distribution of the flame and a very low NOx emission.

The burner in accordance with the invention can process a lean, rich or stoichiometric mixture. If the mixture is rich, the additional combustion air can be brought into the turbulence cells from above, for instance drawn from ducts mounted for that purpose.

Figure 7:
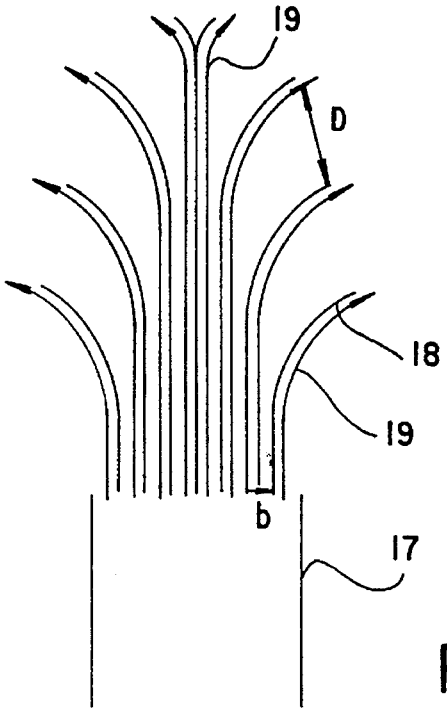

FIG. 7 shows a schematic cross-section of an atmospheric burner, in which in a shaft 17 gas has been blown in, which in a known manner carries along combustion air along a number of partitions 18 bent outwards, which have been mounted for this purpose, along which gas flows 19 have been guided. On the upper side a straight flow partition has been mounted. The gas flows 19 remain adjacent to the bent blades 18 due to the deflection and/or the Coanda effect, and at the outside they exit with an in-between distance that may be named D again and has the same function as the distance D in FIG. 1. The distance between two successive guiding members 18 approximately corresponds to the thickness of the layer flowing along such a wall and, therefore, to the distance b in FIG. 1. At the upper side the central guiding partition may be somewhat bent outward, so that there as well two diverging gas flows are obtained that flow along the guiding partitions.

The embodiment in FIG. 7 makes for a simple and reliable atmospheric burner with, for an atmospheric burner, an extremely low NOx emission.

Figure 8:
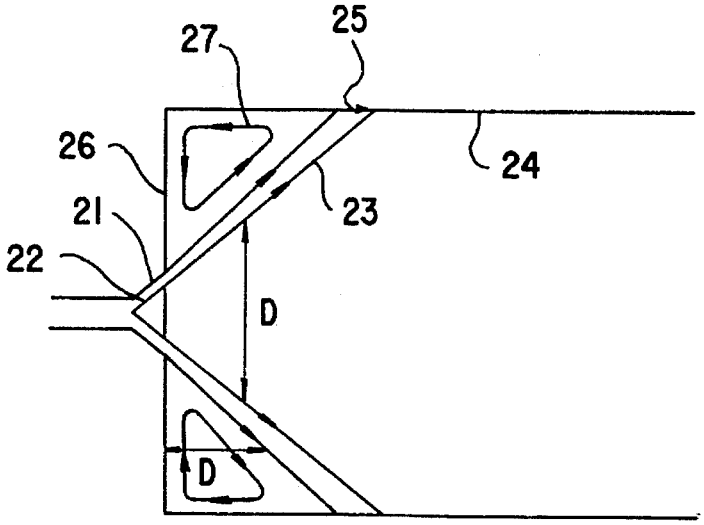

In FIG. 8 by 21 a hollow cone is indicated in which a conical body 22 is situated. The cones 21 and 22 surround a conoid-shaped opening, from where a gas jet 23 can exit. In case of a premix-burner, said gas jet will contain a gaseous oxidant, such as combustion air and fuel, preferably combustible gas, both a deficiency and an excess being possible. The jet 23 strikes the wall 24 in the point of impact 25, resulting in the jet partly being guided to the right and partly being carried back. This has been indicated by the circulation 27 that takes place between the back wall 26 of the burner and the wall 24, and feeds to the jet 23 close to its base entirely or partly burnt gas that is so hot that the jet ignites as a result. Partly due to this admixture, the velocity of the jet will slightly decrease and the flame will leave the burner pipe 24 to the right. It has experimentally been established that the flame is particularly calm, and is stable at relatively wide variations in the flow velocity of the jet 23.

In case that the wall is cooled, additional reduction of the NOx concentration may be effected.

Figure 9:
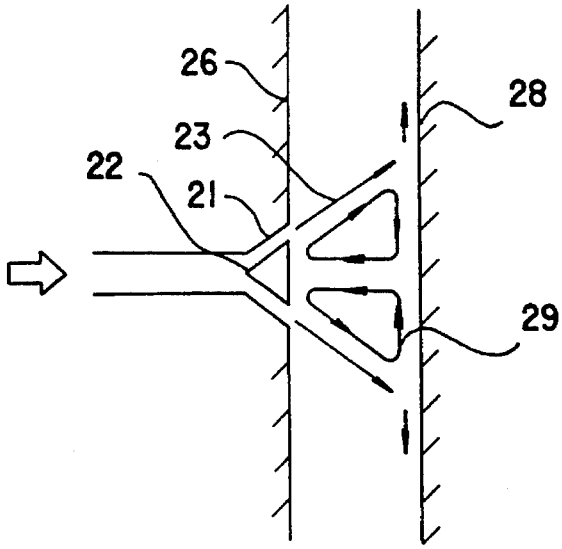

In FIG. 9 same parts are indicated by the same references. In this case, however, the circular wall 24 has been replaced by a wall 28 perpendicular to the axis of the cones. Now a ring-shaped vortex 29 occurs, which ignites the jet 23 in an manner indicated hereinabove.

In the embodiment of FIGS. 8 and 9 the burner and the therein appearing flame are circular symmetric.

It is, however, quite possible to use a flat jet, for example by flattening slits between 21 and 22 and by replacing the cylinder 24 by two flat walls.

Figure 10:
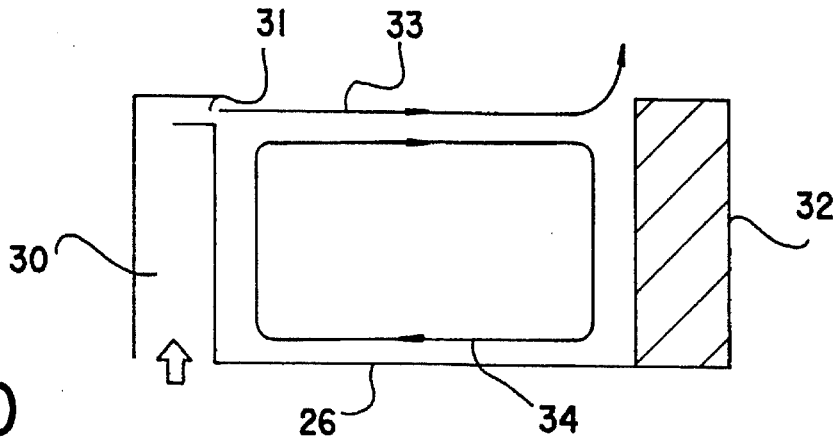

FIG. 10 shows an embodiment, in which the gas mixture supply 30 penetrates the wall 26 and through an opening 31 flows out parallel to the surface 26. An obstruction 32 deflects the jet 33, which leaves 31, partly upward, but part of it goes down as well to form the vortex 34. Also in this embodiment the flat jet 33 is ignited by the vortex 34 and the point where the combustion starts is practically fixed. Furthermore, also given the extreme reduction of the flow velocity that occurs after hitting the obstruction 32, it is virtually impossible to blow off the flame.

Figure 11:
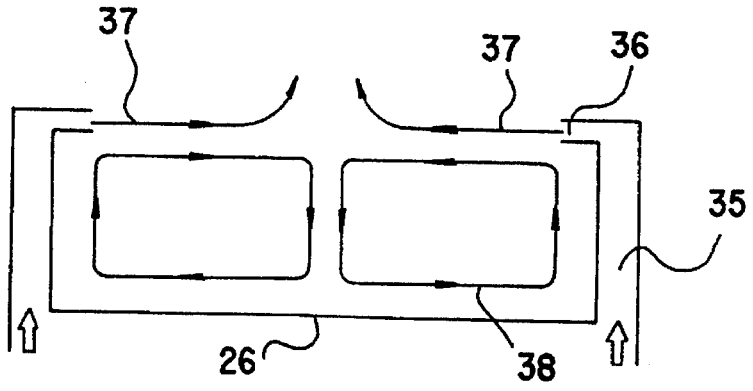

FIG. 11 shows an embodiment in which two feeding devices 35 for a mixture of combustible gas and combustion air, leaving the surface 26, flow out at 36 parallel to the surface 26. The jets 37 collide and are partly deflected upward and partly downward. In this case then the jets 37 function for each other as flow guiding means. The downward deflection leads to two vortices 38, which in their turn ignite the jets 37. Here again the chance of the flame blowing off is extremely slight, given the substantial reduction of velocity after the jets' collision.

Figure 12:
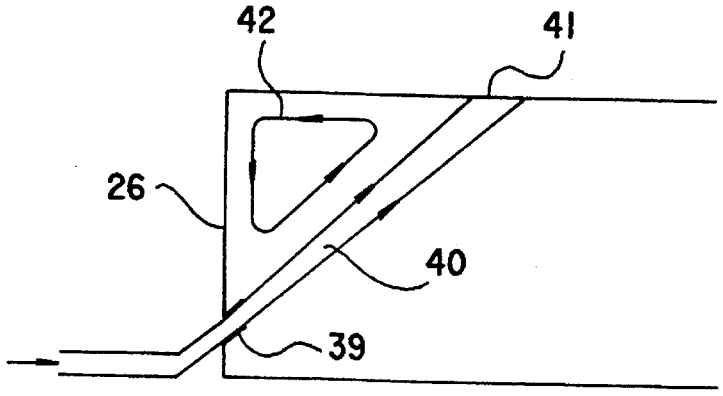

In FIG. 12 an embodiment is presented with a passage slit 39 directed under an angle, leaving again the wall 26. The jet 40 exiting the slit 39 strikes a wall 41, which again causes a vortex 42.

Naturally, instead of the wall 41, a slit can also be introduced, which is a mirror image of the slit 39 in relation to the wall 41. This way it is possible to construct a burner with a number of consecutive slits placed under an angle, which, of course, can have a very great capacity. Such a very wide rectangular burner pipe is economical, in particular for large burners.

Figure 13:
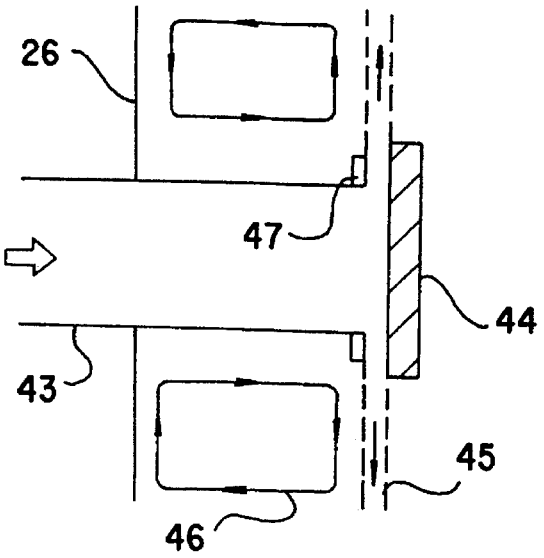

FIG. 13 shows an embodiment for a simple burner with a relatively great capacity, for instance several mega-watts. Through the wall 26 a round pipe 43 is conducted with a relatively large diameter, for instance 25 cm. Opposite the end of said pipe a guiding plate 44 is situated, which deflects off the jet in the tube 43 forming a circular radially outflowing flat jet 45. Said jet, together with the back wall 26 again forms a ring vortex 46, resulting in flame stabilization. The burner indicated can function with a slit measuring 3 to 4 cm between the ends of pipe 43 and the flow guiding member 44. In order to give the jet some direction a flange 47 has been placed at the end of the pipe 43.

The embodiment examples of FIGS. 8–13 all have a very low flow resistance. Therefore, it is often possible to produce these burners as atmospheric burners, i.e. a burner in which the momentum of the combustion air is derived from the pressure drop of the outflowing gas.

Figure 14:
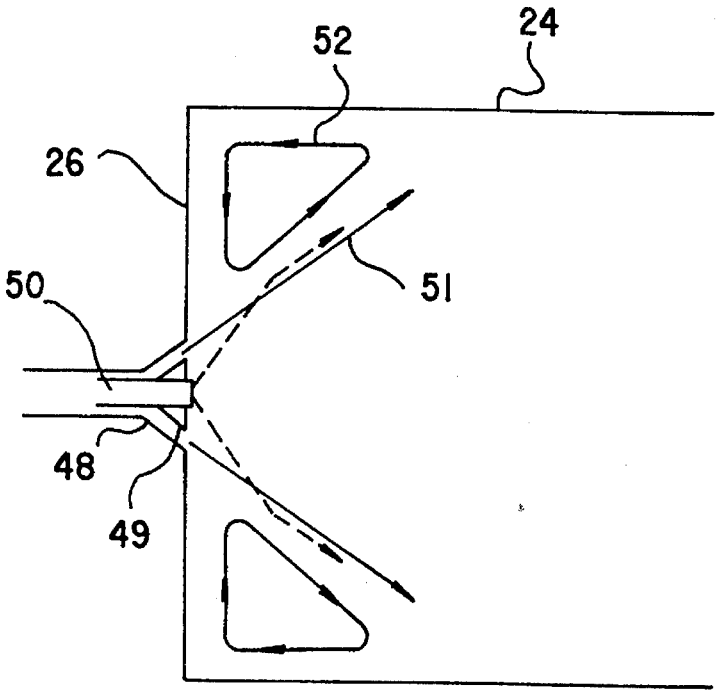

In FIG. 14 a diagram is drawn indicating how the invention is applicable to an oil burner. Again two conical parts 48 and 49 are present which form a conoid-shaped jet. An oil spray or atomizer of solid powdered fuel 50 sprays the oil or combustible powder into the jet 51, whereupon, due to collision with the wall 24, again a vortex 52 occurs.

Figure 15:
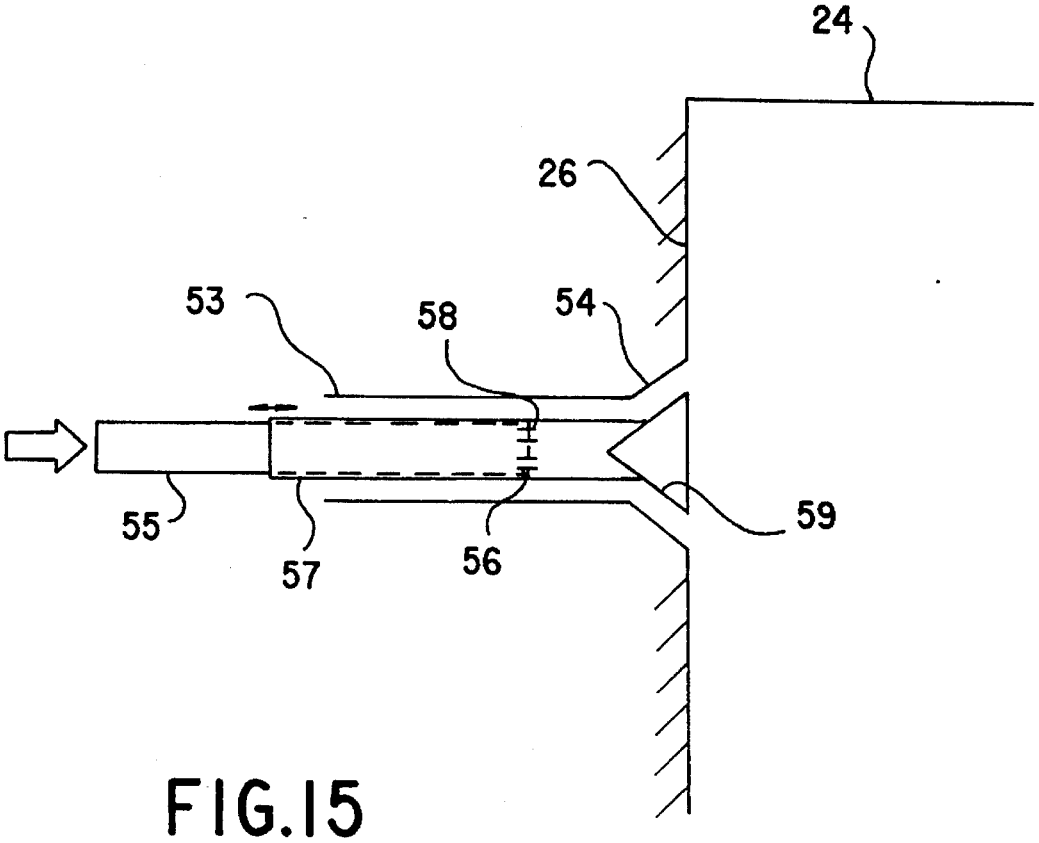

Furthermore, in FIG. 15 an embodiment is drawn of a burner in which the regulations of the gas supply and the air supply are direct connected. In an outer tube 53 which ends in the hollow cone 54 a gas feeding pipe 55 is located, which ends at 56. On the tube 55 there is a tube 57 provided with a ring of openings 58, which has a fixed connection to the inside cone 59. If now the tube 57 is displaced to the right, the air passage between 54 and 59 increases as does the area above which the slits 58 have a free connection with the gas supply. Such an adjustment has the advantage that the gas passage and the air passage are directly connected. In most cases this is preferable to the more expensive adjustment of two valves, which often have some backlash when reversing the adjustment direction, which is mostly disadvantageous for the fine-adjustment of the burners.

FIG. 16 shows an embodiment with a feeding slit 60, above which a horizontal guide plate 61 is located. Between upward bent bottom plates 62 and said guide plate 61 there are exit slits 63 from where a layer-shaped flow of combustion air and gaseous fuel exits, which, due to the bending and the Coanda effect, moves along the bend of the plates 62 and eventually collides horizontally with the walls 64 of a cylinder and from there partly flows back and partly bends upward and burns up. Within the cylinder 64 a residual gas is drawn, so that the gas flow 63 moving along the plates 62 mixes with it. The result is a very stable burner with an extremely low NOx content over an ample adjustment range.

In FIGS. 17 and 18 an embodiment is schematically indicated with a feeding pipe 70 having a central restraining member 71, causing a flow 72 to occur along the wall , which in FIG. 18 draws immediately inward and in FIG. 17 first draws outward and than inward due to the bending-out 73. Such a configuration is possible with an oblong cylinder 70 as well as with a round one. Always a flow 72 is established in the shape of a fairly thin peel.

In FIG. 19 the case is drawn when in a flame room the plates 73 are bent outward which causes the flow 74 to be deflected outward due to the Coanda effect. This results in a suction action which leads to a central counterflow that deflects, as has been indicated by 75. The flow 74 is situated between the flow 75 that has been bent back and a vortex 76, so that a very thorough mixing with combustion gases takes place.

FIG. 20 shows the case when the flow 77 is bent inward by means of down-bendings 78, encounters a reverse directed flow and diverges outward again at 79, whereupon a flow pattern can occur analogous to the one in FIG. 19.

Figure 21:
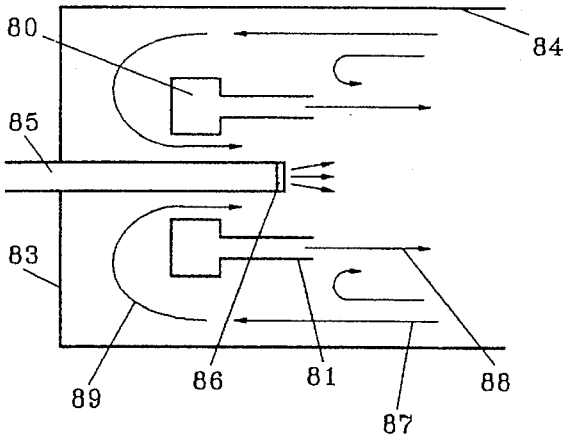

In FIG. 21 an embodiment is drawn wherein the combustion air is fed to a ring-shaped chamber 80 with a ring-shaped exhaust 81, situated in a flame room 82 with a back wall 83 and a side wall 84. Through an oil pipe 85 oil is ejected from a spray nozzle 86. The jet leaving exhaust 81 has a suction action that results in a counterflow 87, which bends back at 89, mixes with the combustion air from the slot 81, carries along the oil sprayed from the nozzle 86 and brings said oil into contact with the air flow leaving 81. This burner has an excellent mixing capacity of residual gas with the combustion air and, as a result, a very low NOx content. Moreover, the flame is very stable, because at the high velocity of the combustion air leaving the slot 81 also a strong counterflow 87 is obtained, which also flows back at 89 and slows down to a considerable degree the air flow coming from the slot 81. Moreover, the flow close to 86 already gives cause for the oil to ignite, so that blowing off is virtually impossible.

Figure 22:
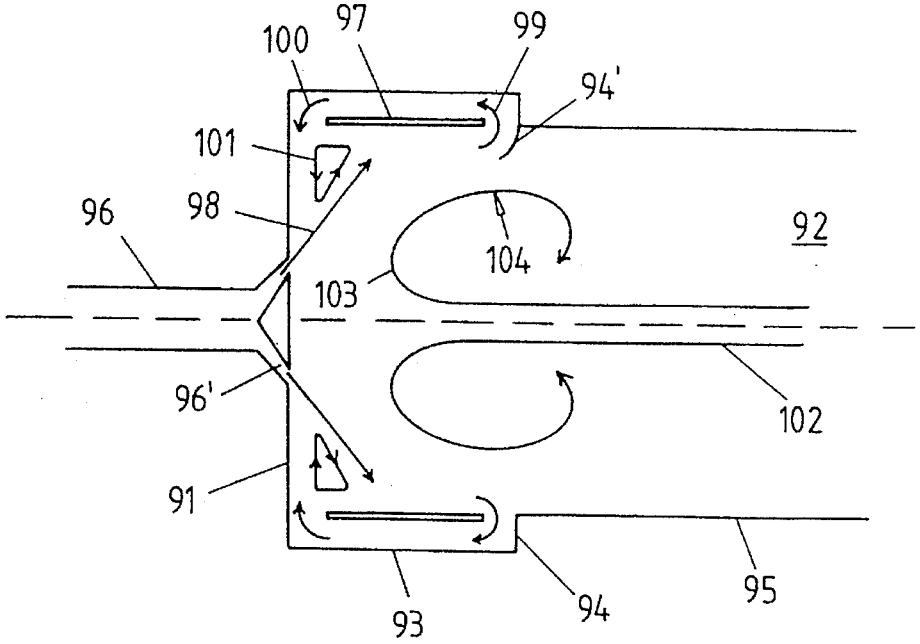

In FIG. 22 by 91 the back wall of a flame room 92 provided with a flame room boundary is indicated, consisting of a first cylindrical part 93, a ring-shaped part 94, which may have a bent ring-shaped extension 94', and an additional cylindrical part 95. Centrally in the back wall a feeding device for combustion air 96 is situated, set up, by means of a conoid-shaped passage 96', to hurl the combustion air on a tube 97 which is coaxial with the axis of the combustion room.

On account of the fact that the combustion air, indicated by the arrows 98, which has been mixed with a fuel by means not drawn, hits the cylinder 97, said combustion air or the combustion gas generated therefrom will strongly flow along the inside of the cylinder 97, resulting in a relatively sharp branching at 99 that reaches the vortex 101, via the arrow 100, and considerably lowers its intensity. In general, said vortex, containing relatively quite an amount of combustion air received via 99 and 100, has a sufficient temperature to ignite the passing layer of combustion air and fuel. Such a return (via 99 and 100) of combustion gases to the base of the flame generally causes a reduction of the NOx content in the exhaust of the burner.

In addition, as is indicated by the vortex 102, a back-drawing flow will be established which bends back again at 103 and thus forms a torus-shaped vortex 104.

Said embodiment is based on the understanding that both vortices 101 and 104 may give cause for oscillations and that their affecting each other through the flow layer indicated by 98, may give cause for a considerable sound production. In this the weakening of the vortices 101 and/or 104 may result in a considerable sound reduction. Experimentally a sound reduction of 10–15 decibels has already been achieved.

Narrowing the flame room boundary by means of the ring 94 has as a result that the flow 99 gets stronger and thus results in a further improvement of the sound reduction, as well as in the reduction of the NOx content.

It will be clear that the ring-shaped surface 94 need not be a straight surface, but for example may have at the downstream side a slightly inward bent rim, like 94', or at the upper side a rounded joint to the flame room boundary 95, so that the flow of gases may even be more improved. Neither need it be that the cylinder 97 is situated exactly at the radial distance from the flame room boundary 93, over which the ring 94 sticks inward from said flame room boundary 93, in which a larger as well as a shorter distance is possible.

Due to the reduction of the diameter of the part 95 in relation to the part 93 of the flame room boundary, the vortex 104 is weakened because the out-flowing gases are situated closer to the axis.

Figure 23:
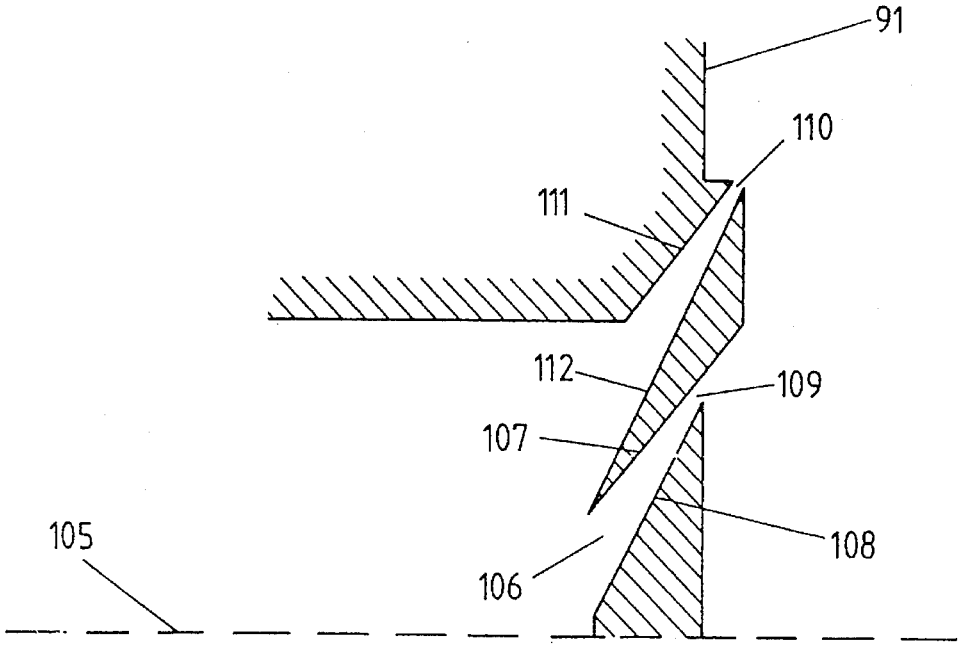

In FIG. 23 an embodiment of the feeding device 96 is schematically represented.

In relation to the axis 105 said feeding device of combustion air is axially symmetric. It is provided with a first circular slit 106, bounded by two conoid-shaped surfaces 107 and 108 that diverge towards each other and form a fairly narrow ring-shaped slit at their ring-shaped opening 109. A second ring-shaped slit 110 is bounded by two conoid-shaped surfaces 111 and 112. Naturally, the surfaces 107, 108 and 111, 112 need not be precisely cone-shaped, but may also have the shape of another surface of revolution, for instance a slightly bent shape by which a gradual change in the flow direction of supplied air can be achieved. The cone shape can also be replaced by a pyramid shape, in particular when the side wall 93, 95 has a polygonal section. The slits 109 and 110 may also be straight, oblong slits.

In FIG. 23 the back wall 91 is schematically indicated, but it will be clear that it is not only possible that the slits 109 and 110 are situated in said wall but also that they are located slightly beyond it, as has been drawn.

The air coming from the slits 109 and 110 may be directed parallel to each other or somewhat diverging or converging.

It will be clear that in may cases one single slit will be sufficient, making the construction more simple. More than one slit, however, has the advantage that a better control is achieved of the shape of the air jet flowing out.

In case of a gas burner, it is acceptable to supply the gaseous fuel prior to feeding the combustion air. This may take place in a relatively simple way, because the construction drawn allows for a very thorough mixing of air and combustion gas.

When using such a feeding device for combustion air for an oil burner, the oil can be atomized into the air flows leaving the slits 109 and 110. In this respect it should be pointed out that, when the burner is in operation, the cylinder 97 reaches such a high temperature that the oil coming into contact with said tube evaporates and afterwards, naturally, can burn up in the strong combustion air flow along the inside of said cylinder.

Figure 24:
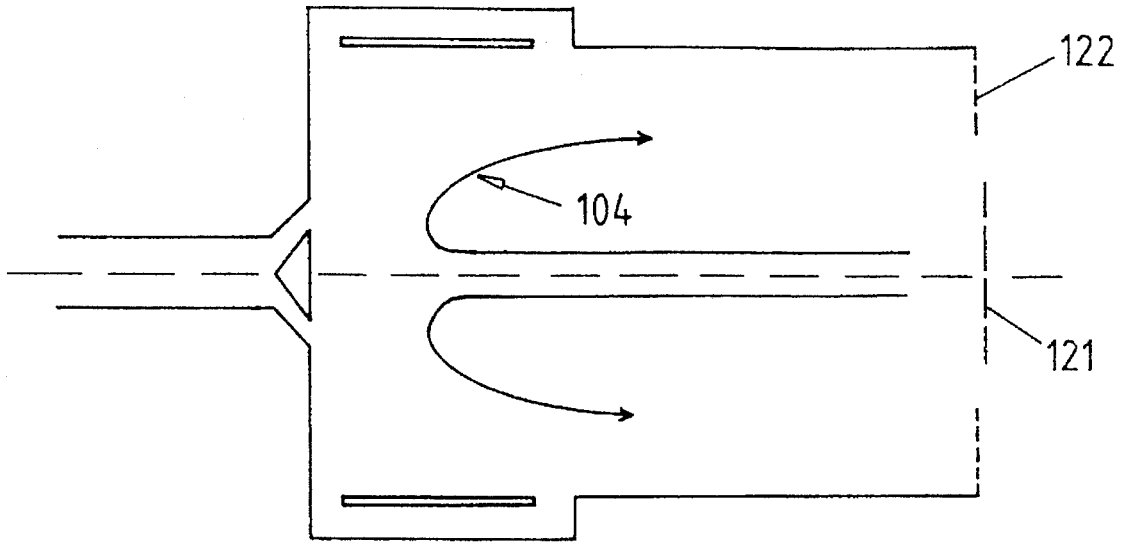

In FIG. 24 an embodiment of the invention is drawn in which a further means to reduce the sound level is indicated. Here, this is effected by obstructing or eliminating the back flow leading to the central vortex 104. A first means to this end is a central plate 121 that direct blocks the axial back flow. A second embodiment is constituted of a rim 122 that directs the out-flowing gas flow toward the axis and by doing so, allows to a lesser degree for back flow near the axis. In this respect it is possible that 121 and/or 122 consist of closed surfaces, or else grids or permeable plates. It is even possible to provide by means of a grid the entire exhaust with a flow resistance, which prevents axial back flow, but such flow resistance will be subject to high heat pressure.

It will be clear that the various embodiments, i.e. directing the combustion air jet 98 to the tube; the narrowing 94 and/or the back-flow guiding 94' and the flow resistances 11 and 112 all have one result in common, namely weakening the vortices 101 and/or 104 and stabilizing the flame.

Figure 25:
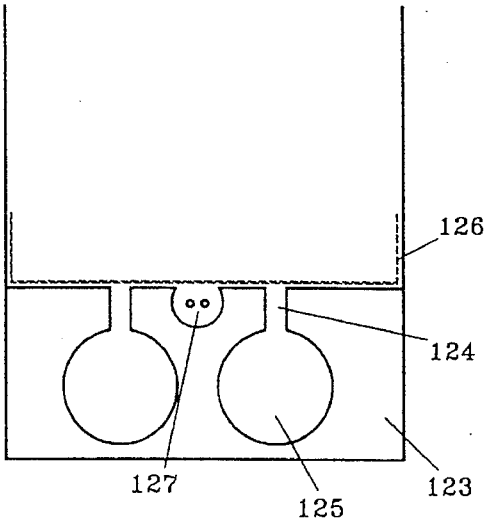
FIGS. 25 and 26 are diagrammatic illustrations of an internal combustion engine incorporating a combustion device in accordance with the invention.

In FIG. 25 application of the invention to the combustion process in a cylinder of an engine with internal combustion, is represented. In the cylinder bottom 123 a ring-shaped slit 124 has been made, which at its bottom side is connected with a ring-shaped cavity 125. The piston 126 is schematically indicated by dotted lines in its lowest position and the ignition 127 is likewise extremely schematically indicated. When the cylinder 126 starts moving upward, at the compression stroke compressed air together with fuel will flow in the space 125 towards the cylinder, whereupon a flow pattern will occur that fully corresponds to the embodiments of the invention as represented hereinabove. The turbulence of the gases leaving the ring slit 124 will ensure a back-feed of burnt gas, as a result of which a combustion with a very low NOx content is achieved.

Figure 26:
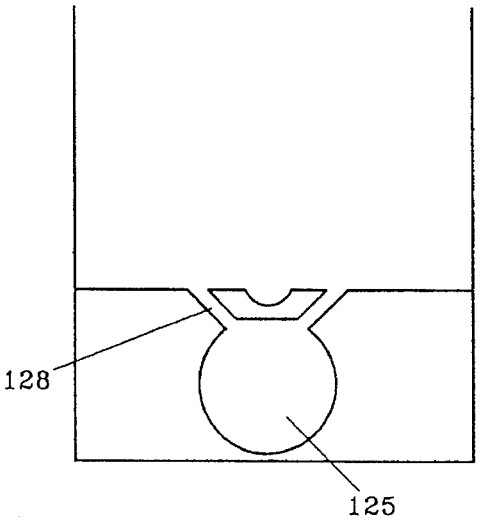

In FIG. 26 another embodiment of said inventive idea is shown, namely by means of funnel-shaped slits 128 that direct a conoid-shaped jet into the cylinder once the piston starts to move back. Naturally, further details concerning valves and the like have been omitted as is the possibility to flush the space 125 or 128 at the suction stroke.

Figure 27:
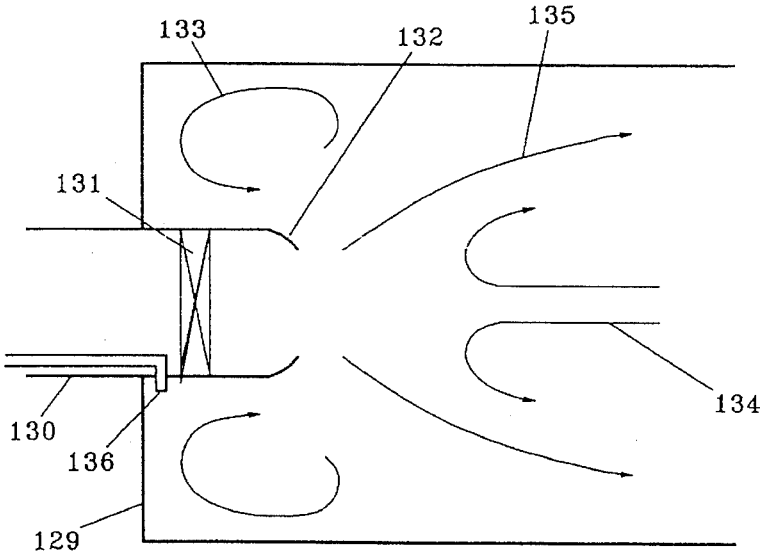

In FIG. 27 a burner is shown with a feeding device 130 that from a back wall 129 sticks inward, and is provided with a rotation body 131 and a narrowing 132. Beyond the narrowing 132 a gas jet containing fuel is hurled outward and, again, the circulation pattern 133 and 134 on both sides of the conoid-shaped jet 135 occurs. In said embodiment, however, additional fuel is injected at 136. Moreover, the air-gas mixture that is fed through the pipe 130 contains an excess of air, so that also the vortex 133 still contains oxygen. Said oxygen ensures the ignition of the additional fuel supply 136, which causes a very stable flame. The NOx content is very low, in the first place because in the layer 135 an excess of air is present, whereupon the recirculation 133 and 134 ensures that also the combustion of the amount of fuel, supplied at 136, takes place at a fairly low temperature. Such a burner not only has a stable flame but also a very wide adjustment range, which may amount, for instance, to more than a factor 30.

FIG. 28 shows a cross-section of a burner plate provided with slits 37 with a width of b. Here the magnitude of D and b is simple to establish, and with regard to ν the kinematic viscosity of the combustion air or of the mixture of combustion air and gaseous fuel is taken in a point at a short distance above the burner plate.

FIG. 29 schematically shows a flame room with in the bottom a centrally mounted conoid-shaped feeding device 139. This burner preferably allows turbulence causing conditions in the area above the conoid-shaped jet 140 and in the area underneath. The value of D is for the upper area at least the diameter D1 of the feeding device and at most the diameter D2 of the flame room. Because, however, a fairly strong upward directed flow occurs along the wall 141, in that area turbulences are driven away, so that, there, a value that is approximately the average of D1 and D2 applies. Because D3 and D4 are indicative in the lower area, it is to be recommended for very low NOx contents to use the smallest of the values ½ (D2–D1), D3 and D4.

In FIG. 30 the flat wall 141, the bottom 142 and the flat wall 143 together with the linear slit feeding pipe 143 form a first embodiment with D5 as value for the formula for turbulence formation. The second embodiment is created by omitting 143 and by providing the wall 144 with a slit-shaped feeding device 145. Here the significant value for D is D6, because above the point of impact of the jets there is sufficient space to form turbulences and said turbulences can virtually freely move downward influenced by the suction action of the flat jets leaving the slits.

Figure 31:
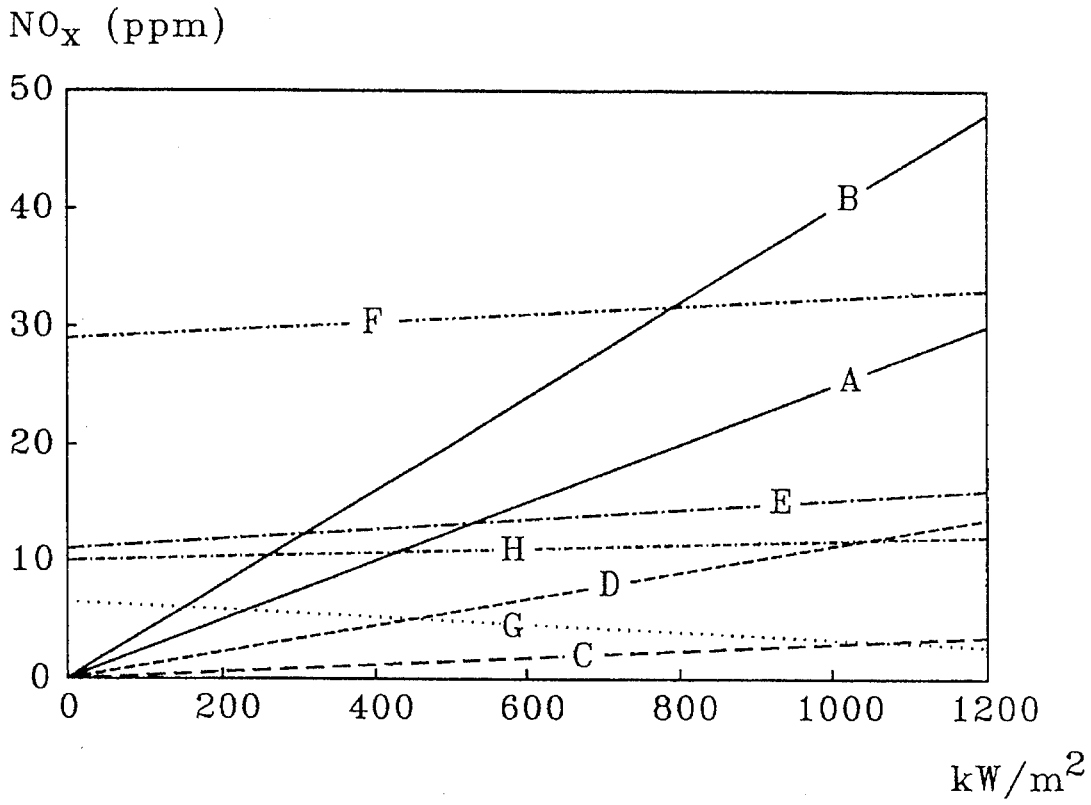
FIG. 31 is a representation of $NO_x$ values as a function of heating load for various combustion devices.

Finally, in FIG. 31 the NOx value is indicated in ppm, as function for the load in $kW/m^2$. The lines A and B relate to known premix-burners provided with a porous material and/or a fine distribution of passages and/or a cover made of radiant fire-proof materials. C, D, E and F are the lines belonging to the indicated values of the air excess n, the width of the slit b and the distance between the slits D. It should furthermore be noticed that, at a further rise of the surface load, the various lines C, D, E and F show, from a certain point on, no further increase in the NOx content but remain at constant values.

I claim:

1. Combuster having a flame room having a cylindrical outer wall and provided with a cylindrical guiding element spaced from said cylindrical outer wall to form a back flow passage, said flame room having an end wall with a central opening provided with feed means for a combustible fuel mixture, a conical member located adjacent said central opening forming the combustible fuel mixture into a hollow conical flow directed at said cylindrical guiding element thus causing recirculation of gases through said back flow passage and a central back flow of gases within said hollow conical flow of combustible fuel mixture.

2. Combuster as claimed in claim 1 wherein at least some of said combustible fuel mixture is directed by said conical member at an angle of more than 20° relative to the cylindrical guiding element.

3. Combuster as claimed in claim 1 in which at least some of said combustible fuel mixture is directed by said conical member at an angle of more than 45° relative to the cylindrical guiding element.

4. Combuster as claimed in claim 1 wherein the cylindrical guiding element has a down flow end and in which the wall of the flame room has a narrow down step beyond the down flow end of the guiding element.

5. Combuster as claimed in claim 1 in which the feed means has a radial dimension which is less than 40% of the radial dimension of the flame room at the side of the feed means.

6. Combuster as claimed in claim 1 in which the flame room has a radial back wall, and an end of the guiding element which opposes with the back wall being at a distance to said back wall of at least 8% of the radial dimension of the back wall.

7. Combuster as claimed in claim 1 in which the flame room has a back wall and a feed means for additional fuel located between the feed means of combustible fuel mixture and said back wall.

* * * * *